US005173236A

United States Patent [19]

Yang

[11] Patent Number: 5,173,236

[45] Date of Patent: Dec. 22, 1992

[54] METHOD FOR SPINNING PARA-ARAMID FIBERS OF HIGH TENACITY AND HIGH ELONGATION AT BREAK

[75] Inventor: Hung H. Yang, Richmond, Va.

[73] Assignee: E. I. du Pont de Nemours and Company, Wilmington, Del.

[21] Appl. No.: 673,552

[22] Filed: Mar. 8, 1991

[51] Int. Cl.[5] ..... D01F 6/60

[52] U.S. Cl. ..... 264/184; 264/211.16; 264/233

[58] Field of Search ..... 264/184, 211.16, 210.8, 264/233

[56] References Cited

U.S. PATENT DOCUMENTS

| | | | |
|---|---|---|---|
| 3,869,429 | 3/1975 | Blades | 260/785 |
| 4,016,236 | 4/1977 | Nagasawa et al. | 264/184 |
| 4,560,743 | 12/1985 | Fujiwara et al. | 528/348 |
| 4,859,393 | 8/1989 | Yang et al. | 264/184 |

FOREIGN PATENT DOCUMENTS 0118088 9/1984 European Pat. Off. .

*Primary Examiner*—Jan H. Silbaugh
*Assistant Examiner*—Catherine Timm

[57] ABSTRACT

A process for spinning para-aramid fibers of increased tenacity and elongation at break by using an air-gap means with a spinneret capillary of less than 2.5 mils diameter, a coagulation bath temperature of less than 10C, and tension on the fibers during washing and drying of more than 0.05 and less than 0.35 gpd.

6 Claims, No Drawings

METHOD FOR SPINNING PARA-ARAMID FIBERS OF HIGH TENACITY AND HIGH ELONGATION AT BREAK

BACKGROUND OF THE INVENTION

1. Field of the Invention

This invention relates to a process for air-gap spinning para-aramid fibers wherein a certain combination of spinning process conditions has been found to result in increased fiber tenacity and elongation at break.

2. Description of the Prior Art

U.S. Pat. No. 3,869,429, issued Mar. 4, 1975 on the application of Blades discloses making para-aramid fibers using the so-called "air-gap" spinning process. That patent contains no recommendation of tension for washing; and teaches that drying can be conducted at tensions of less than 0.3 grams per denier, but cites "tensionless" as the only specific lower tension.

U.S. Pat. No. 4,016,236 and 4,560,743, issued Apr. 5, 1977 and Dec. 24, 1985 on the applications of Nagasawa et al. and Fujiwara et al. disclose making aramid fibers by air-gap spinning wherein the spun fibers are carefully dropped onto a netted belt for washing and drying in order to assure that the fibers are not subjected to any substantial tension in either of those operations.

U.S. Pat. No. 4,859,393, issued Aug. 22, 1989 on the application of Yang et al. discloses making para-aramid fibers of increased fatigue resistance by air-gap spinning into a coagulation bath having a temperature of at least 20 C., washing the fibers under a tension of 0.2 to 0.35 gpd, and drying the fibers at a lesser tension of 0.05 to 0.2 gpd.

European Patent Application Number 118,088, published Sep. 12, 1984 on the application of Satoh et al. teaches making para-aramid fibers of improved fatigue resistance whereby the fibers are passed from a coagulating bath to a chamber under reduced pressure.

SUMMARY OF THE INVENTION

The present invention provides a process for making para-aramid fibers exhibiting a combination of increased tenacity and increased elongation at break. The process comprises the steps of extruding an anisotropic spinning dope through the capillaries of a spinneret, passing the extruded dope through an air gap and into and through an aqueous coagulating bath to yield a coagulated fiber, and washing and drying the coagulated fiber. The improvements of the invention are obtained by the following combination of steps: a) extruding the anisotropic spinning dope through a capillary having a diameter of less than 2.5 mils; b) maintaining the coagulation bath at a temperature of less than 10 C.; and c) washing and drying the coagulated fiber at controlled, substantially constant, tensions of 0.05 to 0.35 gpd, preferably 0.05 to 0.25 gpd. All of the aforementioned combination of steps must be used in order to realize the improvement of this invention.

The process of the invention preferably involves the use of rolls in the washing and drying steps so as to carefully control the tension of the fibers.

DETAILED DESCRIPTION OF THE INVENTION

Para-aramid fibers have long been made by air-gap spinning processes wherein an anisotropic solution of the para-aramid is extruded through a spinneret, through an air gap, and through an aqueous coagulation bath before being washed and dried and, optionally, heat treated. General processes for air gap spinning para-aramid fibers are taught in U.S. Pat. No. 3,767,756 and 4,340,559. The present invention relates to an improved combination of process steps for spinning para-aramid fibers which exhibit increased tenacity and increased elongation at break.

By "para-aramid" is meant para-oriented, wholly aromatic polycarbonamide polymers and copolymers consisting essentially of recurring units of the formulae $$-(-NH-AR_1-NH-CO-AR_2-CO-)- \text{ and}$$

$$-(-NH-AR_3-CO-)-$$

wherein $AR_1$, $AR_2$, and $AR_3$, which may be the same or different, represent divalent, para-oriented aromatic groups. By "para-oriented" is meant that the chain extending bonds from aromatic groups are either coaxial or parallel and oppositely directed, for example, substituted or unsubstituted aromatic groups including 1,4-phenylene, 4,4'-biphenylene, 2,6-naphthylene, and 1,5-naphthalene. Substituents on the aromatic groups other than those which are part of the chain extending moieties should be nonreactive and must not adversely affect the characteristics of the polymer for use in the practice of this invention. Examples of suitable substituents are chloro, lower alkyl and methoxy groups. The term para-aramid is also intended to encompass para-aramid copolymers of two or more para-oriented comonomers including minor amounts of comonomers where the acid and amine functions coexist on the same aromatic species, for example, copolymers produced from reactants such as 4-aminobenzoyl chloride hydrochloride, 6-amino-2-naphthoyl chloride hydrochloride, and the like. In addition, para-aramid is intended to encompass copolymers containing minor amounts of comonomers containing aromatic groups which are not para-oriented, such as, for example, m-phenylene and 3,4'-biphenylene.

The preferred para-aramid for practice of this invention is poly(p-phenylene terephthalamide); and by "poly(p-phenylene terephthalamide)" is meant the homopolymer resulting from mole-for-mole polymerization of p-phenylene diamine and terephthaloyl chloride and, also, copolymers resulting from incorporation of small amounts of other aromatic diamine with the p-phenylene diamine and of small amounts of other aromatic diacid chloride with the terephthaloyl chloride. As a general rule, other aromatic diamines and other aromatic diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction.

The process of the present invention, in order to produce fibers of increased tenacity and increased elongation at break, requires certain steps which, when taken individually, would not be expected to yield the improved results; and, when taken in combination, would not seem to be related in a way which would yield the improved results or expectation of the improved results.

In order to spin para-aramid fibers of consistent quality in a manner that permits control of the process and efficiency of the manufacturing facilities, it is much preferred to move fibers through the spinning process by means of wrap rolls or nip roll pairs. It has been disclosed in several publications, such as in those discussed above, that fibers of increased tenacity and increased elongation at break can be made by placing coagulated fibers on a net or porous belt and conducting washing and drying steps with the fibers loosely piddled (arranged) on that net. The fibers are loose on the net, are subject to entanglement and nonuniform treatment by washing solutions and drying forces by virtue of the freedom of the fibers to move on the net, and are subject to entanglement when picked up for removal from the net. The present invention is based on the discovery that rolls can be used in making fibers of increased tenacity and increased elongation so long as the tensions between the rolls are controlled to be very low and so long as the tensions are controlled to be substantially the same in the washing and drying steps. Tensions of the coagulated fibers during the washing and drying steps of this invention must be maintained at 0.05 to 0.35, preferably at 0.05 to 0.25, grams per denier.

In addition to the requirement that tensions in the washing and drying steps must be carefully controlled to be low and substantially the same for washing and drying, it has been discovered that the capillary size of the spinneret and the temperature of the coagulation bath are, also, critically important.

Although not completely understood, it has been found that para-aramid fibers of increased tenacity and increased elongation at break are made by using spinnerets with capillaries having diameters of less than 2.5 mils. The lower limit for capillary diameter is a matter of practicality and is usually not less than about 1.0 mil. Early in development of this invention, it was believed that the fiber quality, as it relates to capillary diameter, was a simple function of the spin stretch factor. The spin stretch factor of a spinning process is the ratio of fiber velocity as it leaves the coagulation bath with fiber velocity as it leaves the spinneret. As a general rule, when the spin stretch factor is increased, the fiber tenacity is increased and the elongation at break is decreased. However, it has been found that, when spinnerets with capillary diameters of less than 2.5 mils are used, along with the other process elements of this invention, the resulting fibers exhibit an increased tenacity and an increased elongation at break;—the increased elongation at break being quite contrary to expectations. While it may still be correct that increased spin stretch factor results in decreased elongation at break, it has been determined that the effect is much diminished using spinneret capillaries with diameters of less than 2.5 mils in accordance with this invention.

As a general rule, it has been the belief that coagulation bath temperatures can be used ranging from −10 C., or less, to 70 C. or 80 C., or higher. In other words, it has been the belief that fiber quality is more or less independent of coagulation bath temperature. While it has been the popular recommendation that the coagulation bath temperature should be as low as possible, it is noted that above-discussed U.S. Pat. No. 4,859,393 requires a coagulation bath temperature greater than 20 C. to make fibers of increased tenacity without any specified concern for improvement in elongation at break. For practice of this invention, it has been determined that a coagulation bath temperature of less than 10 C., and preferably less than 5 C., is necessary, along with the other process elements which serve to define the combination of elements constituting this invention. The lower limit for the coagulation bath temperature is a matter of practicality; but temperatures of less than −10 C. are unnecessary.

As can be concluded from the results of Examples to follow, all three of the novel combination of process elements are required for practice of this invention; and use of less than all of the three elements does not lead to the benefits of the invention.

DESCRIPTION OF THE PREFERRED EMBODIMENTS

The following are illustrative of this invention and are not intended as limiting:

Yarns were spun for the following examples, generally as described in U.S. Pat. No. 4,340,559, using Tray G thereof but always with spinneret capillaries less than 2.5 mils, with coagulating bath temperature less than 10 C., and with washing and drying tensions from 0.05 to 0.35 gpd. The polymer, in every case, was poly(paraphenylene terephthalamide) (PPD-T) having an inherent viscosity of 6.3 dL/g. The polymer was dissolved in 100.1% sulfuric acid to form dopes containing 19.4 percent polymer (based on total weight of the dope). Each dope was deaerated in a vacuum and was spun through a multiple-orifice spinneret of which each of the identical spinning capillaries had a diameter of 2.0 mil (0.051 mm). Spinning was conducted at a dope temperature of 71 C. directly into an air gap 0.64 cm in length and thence into a spin tube together with coagulating liquid which was an aqueous solution containing 8% by wt. $H_2SO_4$ maintained at 2 C. In the TABLE, below, the spin stretch factor is identified as a process condition. The coagulated yarn was forwarded from the coagulation bath to a water-washing stage, to a neutralization stage, to drying on a pair of internally steam-heated rolls with surface temperature of 125 C, and then to windup on bobbins at a moisture content of about 12 wt. %. Yarn tensions during washing and neutralization were constant and were measured just prior to each stage. Drying tension was also measured just prior to wrapping onto the dryer rolls. Fluctuations in roll speed caused variations of +/−10% in tension. Process conditions unique to each test are shown in the TABLE below. The results reported do not include all experiments in accordance with the invention but are believed to be representative.

TABLE

| | EXAMPLES | | COMPARATIVE EXAMPLES | | |
|---|---|---|---|---|---|
| | 1 | 2 | A | B | C |
| PROCESS CONDITIONS: | | | | | |
| Capillary dia., (mils) | 2.0 | 2.0 | 2.5 | 2.5 | 2.5 |
| Spin Stretch Factor | 4.14 | 4.14 | 6.47 | 6.47 | 6.47 |
| Coagulation temp., °C. | 2 | 2 | 2 | 2 | 20 |
| Wash tension, g/den | 0.25 | 0.25 | 0.4 | 0.4 | 0.2 |
| Drying tension, g/den | 0.25 | 0.25 | 0.7 | 0.7 | 0.2 |
| Yarn speed, yd/min | 350 | 350 | 350 | 350 | 300 |
| YARN PROPERTIES: | | | | | |
| Denier | 1500 | 850 | 1500 | 850 | 1500 |
| Denier per filament | 1.5 | 1.5 | 1.5 | 1.5 | 1.5 |
| Tenacity, g/den | 27.3 | 26.5 | 24.5 | 23.8 | 24.0 |
| Elongation at break, % | 4.5 | 4.3 | 3.6 | 3.9 | 4.4 |
| Modulus, g/den | 470 | 483 | 620 | 516 | 430 |
| Toughness (TxE/2) | 0.614 | 0.570 | 0.441 | 0.464 | 0.528 |

The spinning process of Examples 1 and 2 represents the process of this invention and utilized spinneret capillaries of 2 mils, coagulation bath temperatures of 2 C., and tension in washing and drying of 0.25 grams per denier. For examples of the invention, the yarn tenacities were greater than 26 gpd and the elongations at break were greater than 4%.

The Comparative Examples illustrate attempts at spinning fibers by processes using less than all of the process conditions required by the present invention.

Comparative Examples A and B utilized a spinneret capillary with a diameter of greater than 2 mils and unequal yarn tension greater than 0.35 gpd. Resulting yarn tenacities are less than 26 gpd and elongations are less than 4%.

Comparative Example C utilized a spinneret capillary with a diameter of greater than 2 mils and a coagulation bath temperature of greater than 10 C. the resulting yarn tenacity is substantially less than 26 gpd.

In a study of the prior art, it is noted that above-discussed U.S. Pat. No. 4,016,236 mentions, in Example 1, that fibers spun from spinneret capillaries of 2.1 mil diameter into coagulation bath of temperature 3 C. and washed and dried on nets at zero tension exhibit an elongation of 6.8% but a tenacity of only 21.3 gpd.

Along the same lines, Example II*a* of U.S. Pat. No. 3,869,429 discloses that fibers spun from spinneret capillaries of 2 mils into a coagulation bath of 1 C. and washed and dried freely wound up on bobbins at unspecified, but probably zero, tension, result in fibers of tenacity from 21.2 to 24.8 gpd and elongation from 2.8 to 3.9%.

Example 1 of U.S. Pat. No. 4,560,743 discloses the preparation of filaments having tenacities of 35.8 to 40.2 gpd and elongation of 5.3 to 6.1%. The process discloses use of spinneret capillaries having diameters of 2.5 mils, coagulation bath temperatures of −10 C., and zero tension by use of nets for washing and drying steps. As stated, above, processes of zero tension in washing or drying eliminate all desired control of the fibers for handling and increase the probability of entanglement during processing. Tensile properties for filaments are known to be substantially different from tensile properties for yarns.

I claim:

1. In the process for making poly(p-phenylene terephthalamide) fibers comprising the steps of extruding an anisotropic spinning dope through the capillaries of a spinneret, passing the extruded dope through an air gap and into and through an aqueous coagulating bath to yield a coagulated fiber, and washing and drying the coagulated fiber:

the improvement comprising:

a) extruding the anisotropic spinning dope through a capillary having a diameter of less than 2.5 mils;

b) maintaining the coagulation bath at a temperature of less than 10 C.; and c) washing and drying the coagulated fiber at a controlled, substantially constant, tension of 0.05 to 0.35 gpd to yield fibers exhibiting a yarn tenacity greater than 26 grams per denier and an elongation at break greater than 4%.

2. The process of claim 1 wherein the coagulation bath temperature is maintained at −10 C. to 10 C.

3. The process of claim 1 wherein the spinneret capillary diameters are less than 2.5 mils and greater than 1.0 mil.

4. The process of claim 1 wherein the tensions through washing and drying are maintained at 0.05 to 0.25 gpd.

5. The process of claim 1 wherein the tensions through washing and drying are maintained at substantially the same level.

6. The process of claim 1 wherein the transporting of the fibers through washing and drying is conducted on rolls.

* * * * *